US011047025B2

(12) United States Patent
Qin et al.

(10) Patent No.: US 11,047,025 B2
(45) Date of Patent: Jun. 29, 2021

(54) HIGH-STRENGTH DISSOLVABLE ALUMINUM ALLOY AND PREPARATION METHOD THEREFOR

(71) Applicant: PHENOM INNOVATIONS (XI'AN) CO., LTD., Shaanxi (CN)

(72) Inventors: Yi Qin, Shaanxi (CN); Ting Zhao, Shaanxi (CN); Yajie Zhang, Shaanxi (CN); Yonghui Xu, Shaanxi (CN)

(73) Assignee: PHENOM INNOVATIONS (XI'AN) CO., LTD., Xi'an (CN)

( * ) Notice: Subject to any disclaimer, the term of this patent is extended or adjusted under 35 U.S.C. 154(b) by 371 days.

(21) Appl. No.: 15/551,036

(22) PCT Filed: Apr. 17, 2015

(86) PCT No.: PCT/CN2015/000274

§ 371 (c)(1),
(2) Date: Aug. 14, 2017

(87) PCT Pub. No.: WO2016/165041

PCT Pub. Date: Oct. 20, 2016

(65) Prior Publication Data

US 2018/0016662 A1 Jan. 18, 2018

(51) Int. Cl.
*C22C 1/02* (2006.01)
*C22C 21/00* (2006.01)

(52) U.S. Cl.
CPC ..... *C22C 21/003* (2013.01); *C22C 1/02* (2013.01); *C22C 1/026* (2013.01); *C22C 21/00* (2013.01)

(58) Field of Classification Search
None
See application file for complete search history.

(56) References Cited

U.S. PATENT DOCUMENTS 2,793,949 A * 5/1957 Imich ..... C22C 1/02 420/528
4,007,923 A * 2/1977 Chia ..... C22B 21/066 266/217
4,419,143 A * 12/1983 Ito ..... C22F 1/043 148/416
4,731,132 A * 3/1988 Alexander ..... C22C 1/1026 148/437
4,739,817 A * 4/1988 Hamajima ..... C22C 1/026 164/120
2007/0181224 A1 8/2007 Marya et al.
2009/0226340 A1 9/2009 Marya

FOREIGN PATENT DOCUMENTS

CN 101560619 A 10/2009
CN 102102158 A 6/2011
CN 104480354 A 4/2015
JP 2007291450 A * 11/2007

OTHER PUBLICATIONS

English Translation of JP 2007291450 (originally published Nov. 2007) from Espacenet.*
English Translation of CN 104480354 (originally published Apr. 1, 2015) from Espacenet.*
International Search Report of PCT Patent Application No. PCT/CN2015/000274 dated Jan. 20, 2016.
Notification to Grant Patent Right for Invention of Counterpart Chinese Patent Application No. 201580036911.2 dated Nov. 5, 2018.

* cited by examiner

*Primary Examiner* — George Wyszomierski

(57) ABSTRACT

The present invention relates to a technical field of functional materials, and in particular to a high-strength dissolvable aluminum alloy and a preparation method therefor. In order to solve the problem of a relatively low strength of the existing dissolvable materials, a high-strength dissolvable aluminum alloy material and a preparation method therefor are provided. The raw materials of the high-strength dissolvable aluminum alloy comprise: aluminum, a functional metal, and a metal oxide; the addition amounts of the aluminum and the functional metals are: 60-99 wt. % of aluminum, 0.9-39.9 wt. % of the functional metals; and the addition amount of the metal oxide is: 0.01-11 wt. %. The high-strength dissolvable aluminum alloy can not only meet the usage requirements of high mechanical strength in service, but can also rapidly degrade after the service is completed. In addition, the preparation method of this material is simple, low in cost, and easy for large-scale production.

6 Claims, 1 Drawing Sheet

HIGH-STRENGTH DISSOLVABLE ALUMINUM ALLOY AND PREPARATION METHOD THEREFOR

TECHNICAL FIELD

This invention relates to the technical field of functional materials, especially to a high-strength soluble aluminum alloy (high-strength dissolvable aluminum alloy) and its corresponding preparation method.

BACKGROUND ART

During the process of oilfield exploitation, a number of downhole tools are needed. The most ideal condition is that all these downhole tools not only can satisfy the operating requirement during the service period, but also can degrade quickly after invalidation. The shaft shall be kept unblocked and the resource waste during the process of recycling the component can be avoided. In addition, several of tools need to service under the condition of high temperature and high pressure, which requires the tools shall be soluble, meanwhile, have higher mechanical strength to satisfy the pressure-bearing requirement. Therefore, develop a kind of high-strength soluble material to manufacture the downhole tools is a current technical problem that needed to resolve.

Currently, the most common soluble materials mainly include organic polymer materials, but it cannot afford the fracturing requirements such as high temperature and high pressure, at the same time, it has to be used under special conditions, such as light, which has strict requirements for fracturing environment. In addition, in recently years, the solution rate of soluble inorganic materials, such as magnesium alloy, biological ceramics, that apply to biological fields is slow; meanwhile, if there has no certain biological environment, the fracturing environment cannot be satisfied.

American patent US 2007/0181224 A1 (publication date is Aug. 9, 2007) publics a kind of compound, which includes one or more reactive metals that occupy major proportion and one or more alloying products that occupy a small proportion. It mainly includes metal and alloy products of I and II category in the Periodic Table, such as function alloy gallium (Ga), indium (In), zinc (Zn), bismuth (Bi), and aluminum (Al). The compound has features of having controllable for activity and degradable under certain conditions. However, because of the materials have strong metallic properties, the compression strength only reach to dozens of MPa. Similarly, Chinese patent 200910130736.X (publication date is Oct. 21, 2009) also use the melt and power of metals and alloy compound mentioned above to get the soluble alloy, but it does not involve mechanical properties.

The downhole tools such as the supporting part of soluble bridge plug slip has higher requirements for mechanical strength, hence, we hope to develop a kind of material that having both high mechanical properties and solubility.

DISCLOSURE OF THE INVENTION

In order to solve the problem of lower strength of current soluble material, this invention will provide a high-strength soluble aluminum alloy material and its corresponding preparation method. The high-strength soluble aluminum alloy can satisfy the high mechanical strength operating requirement during the service period, at the same time, it also finish degradation quickly after the service period. In addition, the preparation method is easy, and the cost is low, all of these are benefit for scale production.

In order to achieve this purpose, this invention adopts the following technical scheme: This invention provides a high-strength soluble aluminum alloy; the raw materials of the high-strength soluble aluminum alloy mentioned above comprise aluminum, functional metals and metallic oxide. The addition amounts of aluminum and functional metals mentioned above are as follows: 60-99 wt. % of aluminum and 0.9-39.9 wt. % of functional metals. The addition amount of metallic oxide mentioned above is 0.01-11 wt. %.

For further, the raw materials of high-strength soluble aluminum alloy mentioned above comprise aluminum, functional metals and metallic oxide. The addition amount of aluminum is 98-99 wt. %; The addition amount of functional metals and metallic oxide is 1-2 wt. %. Among these: content of Sn is 0.1-0.2 wt. %, content of Si is 0-0.1 wt. %, content of Mn is 0.1-0.2 wt. %, content of Mg is 0-0.2 wt. %, content of Ga is 0.1 wt. %, content of In is 0.1 wt. %, content of Zn is 0-0.1 wt. %; the weight percentage content of mentioned metallic oxide is 0.2-1.6%.

For further, the mentioned functional metal is one or an alloy of two or more selected from the group consisting of: gallium (Ga), manganess (Mn), indium (In), bismuth (Bi), stannum (Sn), magnesium (Mg), zinc (Zn) and silicon (Si).

Alloy with aluminum and functional metals is known as the aluminum alloy.

For further, the addition amounts of mentioned aluminum and functional metals of mentioned high-strength soluble aluminum alloy are as follows: content of Al is 60-99 wt. %, content of Sn is 0.1-20 wt. %, content of Si is 0-10 wt. %, content of Mn is 0.1-10 wt. %, content of Mg is 0-10 wt. %, content of Ga is 0.1-15 wt. %, content of In is 0.1-10 wt. %, content of Zn is 0-8 wt. %.

For further, the weight percentage of mentioned metallic oxide is: 0.01%, 1%, 3%, 5%, 7%, or 11%.

For further, the activity of metal M in the mentioned metallic oxide MxOy is lower than the activity of metal aluminum.

For further, in the mentioned high-strength soluble aluminum alloy, metallic oxide MxOy mentioned above is one selected from the group consisting of metallic oxides capable of having thermit reaction with aluminum, or a mixture of at least two of the group.

For further, the addition amount of the mentioned aluminum is 87 wt. %, the addition amount of the mentioned metallic oxide is 3 wt. %.

During the preparation process of the above mentioned high-strength soluble aluminum alloy, add one or various kind of metallic oxide MxOy to aluminum or aluminum alloy solution; in aluminum or aluminum alloy solutions occurred the reaction of $3MxOy+2yAl-yAl_2O_3+3xM$, the product of single substance M dissolved in the aluminum alloy melt, $Al_2O_3$ particles are dispersed in the alloy melt which formed soluble alloy with high strength.

For further, in the mentioned high-strength soluble aluminum alloy, the metallic oxide MxOy mentioned above is one selected from the group consisting of chromic oxide ($Cr_2O_3$), molybdenum trioxide ($MoO_3$), manganese dioxide ($MnO_2$), vanadium pentoxide ($V_2O_5$), niobium pentoxide ($Nb_2O_5$), titanium dioxide ($TiO_2$), nickel oxide (NiO), tungsten oxide ($WO_3$) and silicon dioxide ($SiO_2$), or a combination of two or more of the group.

For further, in the mentioned high-strength soluble aluminum alloy, the metallic oxide mentioned above is one selected from the group consisting of titanium dioxide ($TiO_2$), chromic oxide ($Cr_2O_3$) and molybdenum trioxide ($MoO_3$).

For further, in the mentioned high-strength soluble aluminum alloy, the weight percentage of metallic oxide mentioned above is 1%-11%; the content of Al is 60-87 wt. %.

For further, in the mentioned high-strength soluble aluminum alloy, the addition amounts of aluminum and functional metals mentioned above are as follows: Al: 60-87 wt. %, Sn: 3.0-13 wt. %, Si: 0.1-2.0 wt. %, Mn: 0.2-1.5 wt. %, Mg: 1.0-4.0 wt. %, Ga: 0.1-12 wt. %, In: 0.3-5.5 wt. %, Zn: 0.3-1.5 wt. %; and the addition amount of metallic oxide mentioned above is 1-11 wt. %.

For further, in the mentioned high-strength soluble aluminum alloy, the additions amount of aluminum and functional metals mentioned above are as follows: Al: 87 wt. %, Sn: 8.0 wt. %, Si: 0.1 wt. %, Mn: 0.2 wt. %, Mg: 1.0 wt. %, Ga: 0.1 wt. %, In: 0.3 wt. %, Zn: 0.3 wt. %; the addition amount of metallic oxide mentioned above is 3 wt. %.

This invention also provides a method for preparing the high-strength soluble aluminum alloy mentioned, and the mentioned method includes the following steps:

(1) firstly melting aluminum melt, wherein the melting temperature is 660-1,000° C.;

(2) adding functional metals to aluminum melt according to a raw material ratio;

(3) deslagging and degassing, and then adding metallic oxide preheated under a high temperature; and (4) mixing to make alloy ingredients uniform; and manufacturing, after a process of alloying is completed, workpiece products by using a casting process.

For further, the above mentioned method of preparing high-strength soluble aluminum alloy includes the following steps:

(1) Smelt the Aluminum Matrix at High Temperature

Put aluminum ingots into the melting furnace until they are heated up to 660-1000° C. and melt into molten aluminum;

(2) Add functional metals into the molten aluminum, and make them melted with aluminum matrix to form the aluminum alloy. The step (2) includes the mass ratio, melting and stirring process.)

Add functional metals into the molten aluminum prepared in step (1) according to weight percentage, and fully stir them, then preserve heat for 30-120 minutes after they are heated up to 660-1000° C. to obtain the aluminum alloy melt with macroscopic homogeneous property.

(3) Deslagging and Degassing Process

Add defoamer into the aluminum alloy melt prepared in step (2) to carry out deslagging and degasing and make the aluminum alloy melt homogenized. The composition of defoamer in this Step is modified polyether silicon, and the addition thereof is 0.2-1.0 wt. % of total weight of the aluminum alloy melt prepared in step (2).

(4) Add Metallic Oxides Into the Aluminum Alloy Melt to Form Dispersion-Reinforced Phase Preheat the metallic oxides for 1-3 hours under 200-300° C., and cool the aluminum alloy melt to 680-700° C., then add a kind of or variety of metallic oxides into the aluminum alloy melt and fully stir them, then preserve heat for 30-120 minutes after they are heated up to 660-1000° C.

(5) Casting and Cooling

Pour the aluminum alloy melt prepared in step (4) into the preheated mould, and then cool the obtained casting with the mould to room temperature, thus the high-strength soluble workpiece made of aluminum alloy is prepared.

For further, the above-mentioned method of preparing high-strength soluble aluminum alloy includes following steps:

(1) Smelt the Aluminum Matrix at High Temperature

Put aluminum ingots into the melting furnace until they are heated up to 710° C. and melt into molten aluminum;

(2) Add functional metals into the molten aluminum, and make them melted with aluminum matrix to form the aluminum alloy. The Step (2) includes the mass ratio, melting and stirring process.)

Add functional metals into the molten aluminum prepared in Step (1) according to weight percentage, and fully stir them, then preserve heat for 30 minutes after they are heated up to 710° C. to obtain the aluminum alloy melt with macroscopic homogeneous property.

(3) Deslagging and Degasing Process

Add defoamer into the aluminum alloy melt prepared in Step (2) to carry out deslagging and degasing and make the aluminum alloy melt homogenized. The composition of defoamer in this Step is modified polyether silicon, and the addition thereof is 0.2-1.0 wt. % of total weight of the aluminum alloy melt prepared in Step (2).

(4) Add Metallic Oxides Into the Aluminum Alloy Melt to Form Dispersion-Reinforced Phase Preheat the metallic oxides for an hour under 300° C., and cool the aluminum alloy melt to 690° C., then add a kind of or variety of metallic oxides into the aluminum alloy melt and fully stir them, then preserve heat for 30 minutes after they are heated up to 800° C.

(5) Casting and Cooling

Pour the aluminum alloy melt prepared in Step (4) into the preheated mould, and then cool the obtained casting with the mould to room temperature, thus the high-strength soluble workpiece made of aluminum alloy is prepared.

For further, the described mound in step (5) is either spherical mould with diameter of 15-120 mm or cylindrical mould with diameter of 15-120 mm and 15-1000 mm length.

Terminology: In this application, the aluminum refers to the simple substances thereof; aluminum alloy includes the functional metal alloy; high-strength soluble aluminum alloy refers to the aluminum alloy containing $Al_2O_3$ particles; the functional metals include the functional metal existing in metallic simple substances form, or the functional metal existing in alloy form formed with two or more than two kinds of functional metals.

The present invention adopts a kind or variety of metals with activity of metallic oxide MxOy, M inferior to aluminum as raw material so that MxOy can carry out following reactions with aluminum or aluminum alloy under high-temperature melting condition: $3MxOy+2yAl \rightarrow yAl_2O_3+3xM$. This reaction is similar to thermite reaction, which generates nanometer-micrometer $Al_2O_3$ particles or M simple substances. Thereinto, M simple substances inter into the aluminum alloy and help perfect the solubility property of materials, while fine $Al_2O_3$ particles with high hardness, thermostability and corrosion resistance disperse and scatter in the alloy, and play a role in dispersion strengthening, thus the high-strength soluble aluminum alloy is prepared.

Compared with prior art, the high-strength soluble aluminum alloy of the present invention has following advantages: It is prepared by adding the metallic oxides MxOy according to the variety and addition thereof; the bending strength and compressive strength thereof can reach 200-900 Mpa and 70-400 MPa respectively. The preparation method of the material is similar to that of traditional soluble alloy, which has simple process and low cost with mechanical property of the soluble alloy melt strengthened, thus the present invention broaden the application and preparation process. The high-strength soluble aluminum alloy of the present invention can not only be directly applied in satisfying the operating requirements of high mechanical strength on service, but quickly degrade tools and workpieces after the completion of service.

DETAILED DESCRIPTION OF EMBODIMENTS

Next, technical scheme of the present invention will be further described through concrete mode of implementation in the combination of the Figures.

Figure 1:
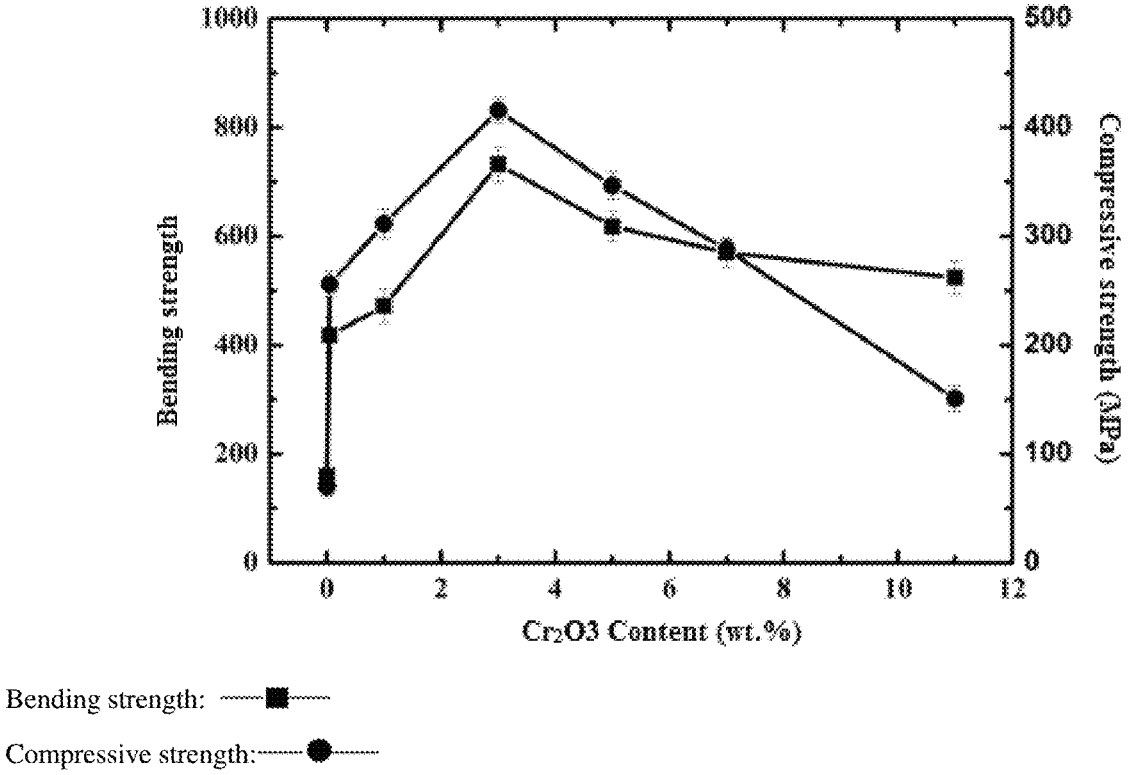
FIG. 1 provides the variation curve diagram displaying the bending strength and compressive strength of a kind of high-strength soluble aluminum alloy of the present invention with adding the oxide $Cr_2O_3$.

As is shown in FIG. 1, the maximum bending strength and compressive strength of the high-strength soluble aluminum alloy of the present invention are 366 MPa and 831 MPa respectively.

Figure 2:
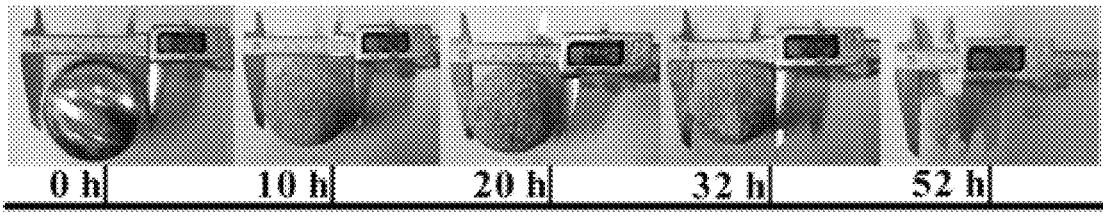
FIG. 2 provides the diagram displaying a kind of high-strength soluble aluminum alloy of the present invention in dissolution.

As is shown in FIG. 2, the high-strength soluble aluminum alloy of the present invention has good solubility property, and the ambient temperature thereof can be adjusted within the range of 50-120° C. by adjusting alloy compositions so that the dissolution rate of the alloy can be adjusted within the range of 0.2-4 mm/h.

This dissolution rate is obtained by measuring diameter variation (decreasing) of the alloying pellet at certain intervals. As the diameter varies linearly with the decreasing of time, we adopt the unit mm/h to indicate the dissolution rate.

Example 1

The present invention provides a kind of high-strength soluble aluminum alloy, which is prepared according to following processes: Add titanium dioxide ($TiO_2$) of 3 wt. % to 97 wt. % into the aluminum alloy melt, and the titanium dioxide will carry out reactions in it: $3MxOy+2yAl-yAl_2O_3+3xM$. Then the product Ti will dissolve in it, while fine $Al_2O_3$ particles will disperse and scatter in it, thus the high-strength soluble aluminum alloy containing $Al_2O_3$ with reinforced phase is formed.

The above-mentioned aluminum alloys include following components:

Al: 87 wt. %, Sn: 8.0 wt. %, Si: 0.1 wt. %, Mn: 0.2 wt. %, Mg: 1.0 wt. %, Ga: 0.1 wt. %, In: 0.3 wt. %, Zn: 0.3 wt. %.

The above-mentioned high-strength soluble aluminum alloy includes following steps:

(1) Smelt the Aluminum Matrix at High Temperature.

Weigh aluminum ingots accounting for 87% of the total weight of the alloy and put them into the melting furnace until they are heated up to 710° C. and melt into molten aluminum;

(2) Carry Out Weight Ratio of the Functional Metals, and Conduct Melting and Stirring Add the metals into the aluminum melt prepared in Step (1) according to following weight ratio: Sn: 8.0 wt. %, Si: 0.1 wt. %, Mn: 0.2 wt. %, Mg: 1.0 wt. %, Ga: 0.1 wt. %, In: 0.3 wt. %, Zn: 0.3 wt. %, then preserve heat for 30 minutes after they are heated up to 760° C. to obtain the aluminum alloy, and fully stir them in this step to obtain the function alloy melt with macroscopic homogeneous property.

(3) Deslagging and Degasing Process

Add the modified polyether silicon defoamer accounting for 0.5 wt. % of the total weight of the alloy melt prepared in Step (2) into the aluminum alloy melt to carry out deslagging and degasing and make the aluminum alloy melt homogenized.

(4) Add Metallic Oxides Into the Aluminum Alloy Melt to Form Dispersion-Reinforced Phase Cool the aluminum alloy melt to 690° C., then weigh the metallic oxide-titanium dioxide ($TiO_2$) with weight percentage of 3 wt. % and preheat them for an hour under 300° C., then add them into the aluminum alloy melt and fully stir them, then preserve heat for 30 minutes after they are heated up to 800° C. to make the alloy melt prepared in Step (3) react with the titanium dioxide:

$3TiO_2+4Al-2Al_2O_3+3Ti$, the resultant Ti elementary substance is dissolved in the alloy melt, and fine $Al_2O_3$ granules are dispersively distributed in alloy melt;

(5) Casting and Cooling

Cast the alloy melt produced in Step (4) in the preheated mould; then cool the produced casting product 5 and the mould to the room temperature, and produce the high-strength and soluble aluminum alloy material.

Example 2

This invention provides a kind of high-strength soluble aluminum alloy, which is produced by adopting the undermentioned method:

(1) Smelt the Aluminum Matrix at High Temperature.

Weigh and put aluminum ingot which occupies 87% of the total weight of the final alloy into the smelting furnace, rise the temperature to 710° C., and smelt it 10 into the melt;

(2) Functional Metals Weight Ratio, Melting and Mixing

According to the weight ratio, add Sn: 8.0 wt. %, Si: 0.1 wt. %, Mn: 0.2 wt. %, Mg: 1.0 wt. %, Ga: 0.1 wt. %, In: 0.3 wt. %, Zn: 0.3 wt. % into the aluminum melt produced in Step (1), preserve the temperature at 760° C. for 0.5 h and smelt to produce aluminum alloy, stir it completely to produce the alloy melt with the 15 macroscopic homogeneous property during Step (2);

(3) Deslagging and Degassing Process

Add into polyether modified silicone antifoam agent which is 0.5 wt. % of the total weight of alloy melt produced in Step (2) for deslagging 10 and degassing and homogenizing alloy melt;

(4) Add Metallic Oxides Into the Aluminum Alloy Melt to Form Dispersion-Reinforced Phas 20 Drop the temperature of alloy melt to 690° C., weigh and preheat the metallic oxide chromium sesquioxide ($Cr_2O_3$) of 3 wt. % of weight proportion for 1 hour under 300° C. into the alloy melt, stir it completely, preserve the temperature at 800° C. for 0.5 h, make the alloy melt produced in Step (3) react with the added chromium sesquioxide: $Cr_2O_3+2Al—Al_2O_3+2Cr$, the resultant Cr elementary substance is dissolved in the alloy melt, and fine $Al_2O_3$ granules are dispersively distributed in alloy melt;

(5) Casting and Cooling

Cast the alloy melt produced in Step (4) in the preheated mould; then cool the produced casting product and the mould to the room temperature, and produce the high-strength soluble aluminum alloy material.

Example 3

This invention provides a kind of high-strength soluble aluminum alloy, which is produced by adopting the undermentioned method:

(1) Melting the Aluminum Matrix Under High Temperature.

Weigh and put aluminum ingot which occupies 87% of the total weight of the final alloy into the smelting furnace, rise the temperature to 710° C., and smelt it into the melt;

(2) Functional Metals Weight Ratio, Melting and Mixing

According to the weight ratio, add Sn: 8.0 wt. %, Si: 0.1 wt. %, Mn: 0.2 wt. %, Mg: 1.0 wt. %, Ga: 0.1 wt. %, In: 0.3 wt. %, Zn: 0.3 wt. % into the aluminum melt produced in Step (1), 10 preserve the temperature at 760° C. for 0.5 h and smelt to produce aluminum alloy, stir it completely to produce the alloy melt with the macroscopic homogeneous property during Step (2);

(3) Deslagging and Degassing Process

Add into polyether modified silicone antifoam agent which is 0.5 wt. % of the total weight of alloy melt produced in Step (2) for deslagging 10 and degassing and homogenizing alloy melt;

(4) Add Metallic Oxides Into the Aluminum Alloy Melt to Form Dispersion-Reinforced Phas Drop the temperature of alloy melt to 690° C., weigh and preheat the metallic oxide molybdenum trioxide ($MoO_3$) of 3 wt. % of weight proportion for 1 hour under 300° C. into the alloy melt, stir it completely, preserve the temperature at 800° C. for 0.5 h, make the alloy melt produced in Step (3) react with the added molybdenum trioxide: $MoO_3$+2Al—$Al_2O_3$+Mo, the resultant Mo elementary substance is dissolved in the alloy melt, and the fine $Al_2O_3$ granules are dispersively distributed in alloy melt;

(5) Casting and Cooling

Cast the alloy melt produced in Step (4) in the preheated mould; then cool the produced casting product and the mould to the room temperature, and produce the high-strength soluble aluminum alloy material.

Example 4

This invention provides a kind of high-strength soluble aluminum alloy, which is produced by adopting the undermentioned method:

(1) Smelt the Aluminum Matrix at High Temperature.

Weigh and put aluminum ingot which occupies 87% of the total weight of the final alloy into the smelting furnace, rise the temperature to 710° C., and smelt it into the melt;

(2) Functional Metals Weight Ratio, Melting and Mixing

According to the weight ratio, add Sn: 8.0 wt. %, Si: 0.1 wt. %, Mn: 0.2 wt. %, Mg: 1.0 wt. %, 5 Ga: 0.1 wt. %, In: 0.3 wt. %, Zn: 0.3 wt. % into the aluminum melt produced in Step (1), preserve the temperature at 760° C. for 0.5 h and smelt to produce aluminum alloy, stir it completely to produce the aluminum alloy melt with the macroscopic homogeneous property during Step (2);

(3) Deslagging and Degassing Process

Add into polyether modified silicone antifoam agent which is 0.5 wt. % of the total weight of alloy melt produced in Step (2) for deslagging 10 and degassing and homogenizing alloy melt;

(4) Add Metallic Oxides Into the Aluminum Alloy Melt to Form Dispersion-Reinforced Phas Drop the temperature of alloy melt to 690° C., weigh and preheat the metallic oxide mixture including titanium dioxide ($TiO_2$) of 2 wt. %, chromic sesquioxide ($Cr_2O_3$) of 0.5 wt. % and molybdenum trioxide ($MoO_3$) of 0.5 wt. % of weight proportion for 1 hour under 300° C. into the alloy melt, stir it completely, preserve the heat under 800° C. for 0.5 hours, make the alloy melt produced in Step (3) react with the added oxides simultaneously: 3MxOy+2yAl-y$Al_2O_3$+3xM, the resultant Ti, Cr, Mo elementary substance are evenly dissolved in the alloy melt, and fine $Al_2O_3$ granules are dispersively distributed in alloy melt;

(5) Casting and Cooling

Cast the alloy melt produced in Step (4) in the preheated mould; then cool the produced casting product 20 and the mould to the room temperature, and produce the high-strength soluble aluminum alloy material.

Example 5

This invention provides a kind of high-strength soluble aluminum alloy, which is produced by adopting the undermentioned method:

(1) Smelt the Aluminum Matrix at High Temperature.

Weigh and put aluminum ingot which occupies 70% of the total weight of the final alloy into the smelting furnace, rise the temperature to 710° C., and smelt it 25 into the melt;

(2) Functional Metals Weight Ratio, Melting and Mixing

According to the weight ratio, add Sn: 12.0 wt. %, Si: 2.0 wt. %, Mn: 1.0 wt. %, Mg: 4.0 wt. %, Ga: 5.0 wt. %, In: 3.5 wt. %, Zn: 1.5 wt. % into the aluminum melt produced in Step (1), preserve the temperature at 760° C. for 0.5 h and smelt to produce aluminum alloy, stir it completely to produce the aluminum alloy melt with the macroscopic homogeneous property during Step (2);

(3) Deslagging and Degassing Process

Add into polyether modified silicone antifoam agent which is 0.5 wt. % of the total weight of alloy melt produced in Step (2) for deslagging 10 and degassing and homogenizing alloy melt;

(4) Add Metallic Oxides Into the Aluminum Alloy Melt to Form Dispersion-Reinforced Phas Drop the temperature of alloy melt to 690° C., weigh and preheat the metallic oxide titanium dioxide 10 ($TiO_2$) of 1 wt. % of weight proportion for 1 hour under 300° C. into the alloy melt, stir it completely, preserve the temperature at 800° C. for 0.5 h, make the alloy melt produced in Step (3) react with the added titanium dioxide: $3TiO_2$+4Al-2$Al_2O_3$+3Ti, the resultant Ti elementary substance is dissolved in the alloy melt, and fine $Al_2O_3$ granules are dispersively distributed in alloy melt;

(5) Casting and Cooling

Cast the alloy melt produced in Step (4) in the preheated mould; then cool the produced casting product and the mould to the room temperature, and produce the high-strength soluble aluminum alloy material.

Example 6

This invention provides a kind of high-strength soluble aluminum alloy, which is produced by adopting the undermentioned method:

(1) Smelt the Aluminum Matrix at High Temperature.

Weigh and put aluminum ingot which occupies 70% of the total weight of the final alloy into the smelting furnace, rise the temperature to 710° C., and smelt it into the melt;

(2) Functional Metals Weight Ratio, Melting and Mixing

According to the weight ratio, add Sn: 13.0 wt. %, Si: 2.0 wt. %, Mn: 1.0 wt. %, Mg: 4.0 wt. %, Ga: 5.0 wt. %, In: 2.5 wt. %, Zn: 1.5 wt. % into the aluminum melt 25 produced in Step (1), preserve the temperature at 760° C. for 0.5 h and smelt to produce aluminum alloy, stir it completely to produce the aluminum alloy melt with the macroscopic homogeneous property during Step (2);

(3) Deslagging and Degassing Process

Add into polyether modified silicone antifoam agent which is 0.2 wt. % of the total weight of alloy melt produced in Step (2) for deslagging 10 and degassing and homogenizing alloy melt;

(4) Add Metallic Oxides Into the Aluminum Alloy Melt to Form Dispersion-Reinforced Phas Drop the temperature of alloy melt to 690° C., weight and preheat the metallic oxide chromium sesquioxide ($Cr_2O_3$) of 1 wt. % of weight proportion for 1 hour under 300° C. into the alloy melt, stir it completely, preserve the temperature at 800° C. for 0.5 h, make the alloy melt produced in Step (3) react with the added chromium sesquioxide: $Cr_2O_3+2Al—Al_2O_3+2Cr$, the resultant Cr elementary substance is dissolved in the alloy melt, and fine $Al_2O_3$ granules are dispersively distributed in alloy melt;

(5) Casting and Cooling

Cast the alloy melt produced in Step (4) in the preheated mould; then cool the produced casting product and the mould to the room temperature, and produce the high-strength soluble aluminum alloy material.

Example 7

The invention provides a kind of high-strength dissoluble aluminum alloy and prepares according to following method:

(1) Smelt the Aluminum Matrix at High Temperature.

Weigh aluminum ingot that is 70% of final total alloy weight, put into melting furnace, heat up to 710° C. and let it turn into melt;

(2) Weight Proportion, Smelting and Mixing of Functional Metal

Add Sn: 13.0 wt. %, Si: 2.0 wt. %, Mn: 1.0 wt. %, Mg: 4.0 wt. %, Ga: 5.0 wt. %, In: 2.5 wt. %, and Zn: 1.5 wt. % into the aluminum melt obtained in Step (1) according to the weight proportion, smelt into aluminum alloy for 0.5 h in 760° C.; sufficiently mix during Step (2) to turn into macroscopic uniform aluminum alloy melt;

(3) Deslagging and Degassing Process

Add polyether modified silicone defoamer that is 0.5 wt. % of total weight of the alloy melt obtained in Step (2) to carry out deslagging and degasification disposal and let alloy melt uniform;

(4) Add Metallic Oxides Into the Aluminum Alloy Melt to Form Dispersion-Reinforced Phas Cool the alloy melt down to 690° C.; weigh 1 wt. % metallic oxide MoO3 and preheat 1 h under 300° C., add into alloy melt, mix sufficiently and keep in constant 800° C. for 0.5 h so that the alloy melt obtained in Step (3) and added $MoO_3$ react: $MoO_3+2Al—Al_2O_3+Mo$; the product Mo simple substance dissolves in the alloy melt, while the tiny $Al_2O_3$ particles diffuse in alloy melt;

(5) Casting and Cooling

Cast the alloy melt obtained in Step (4) into preheated mould; then cool the obtained casting along with the mould down to indoor temperature and make high-strength dissoluble aluminum alloy materials.

Example 8

The invention provides a kind of high-strength dissoluble aluminum alloy and prepares according to following method:

(1) Smelt the Aluminum Matrix at High Temperature.

Weigh aluminum ingot that is 60% of final total alloy weight, put into melting furnace, heat up to 710° C. and let it turn into melt;

(2) Weight Proportion, Smelting and Mixing of Functional Metal

Add Sn: 3.0 wt. %, Si: 2.0 wt. %, Mn: 1.5 wt. %, Mg: 4.0 wt. %, Ga: 12 wt. %, In: 5.5 wt. %, and Zn: 1.0 wt. % into the aluminum melt obtained in Step (1) according to the weight proportion, smelt into aluminum alloy for 0.5 h in 760° C.; sufficiently mix during Step (2) to turn into macroscopic uniform aluminum alloy melt;

(3) Deslagging and Degassing Process

Add polyether modified silicone defoamer that is 0.5 wt. % of total weight of the alloy melt obtained in Step (2) to carry out deslagging and degasification disposal and let alloy melt uniform;

(4) Add Metallic Oxides Into the Aluminum Alloy Melt to Form Dispersion-Reinforced Phas Cool the alloy melt down to 690° C.; weigh 11 wt. % metallic oxide $TiO_2$ and preheat 1 h under 300° C., add into alloy melt, mix sufficiently and keep in constant 800° C. for 0.5 h so that the alloy melt obtained in Step (3) and added $TiO_2$ react: $3TiO_2+4Al-2Al_2O_3+3Ti$; the product Ti simple substance dissolves in the alloy melt, while the tiny $Al_2O_3$ particles diffuse in alloy melt;

(5) Casting and Cooling

Cast the alloy melt obtained in Step (4) into preheated mould; then cool the obtained casting along with the mould down to indoor temperature and make high-strength dissoluble aluminum alloy materials.

Example 9

The invention provides a kind of high-strength dissoluble aluminum alloy and prepares according to following method:

(1) Smelt the Aluminum Matrix at High Temperature.

Weigh aluminum ingot that is 60% of final total alloy weight, put into melting furnace, heat up to 710° C. and let it turn into melt;

(2) Weight Proportion, Smelting and Mixing of Functional Metal

Add Sn: 13.0 wt. %, Si: 2.0 wt. %, Mn: 1.5 wt. %, Mg: 4.0 wt. %, Ga: 6.5 wt. %, In: 1.0 wt. %, and Zn: 1.0 wt. % into the aluminum melt obtained in Step (1) according to the weight proportion, smelt into aluminum alloy for 0.5 h in 760° C.; sufficiently mix during Step (2) to turn into macroscopic uniform aluminum alloy melt;

(3) Deslagging and Degassing Process

Add polyether modified silicone defoamer that is 1.0 wt. % of total weight of the alloy melt obtained in Step (2) to carry out deslagging and degasification disposal and let alloy melt uniform;

(4) Add Metallic Oxides Into the Aluminum Alloy Melt to Form Dispersion-Reinforced Phas Cool the alloy melt down to 690° C.; weigh 11 wt. % metallic oxide $Cr_2O_3$ and preheat 1 h under 300° C., add into alloy melt, mix sufficiently and keep in constant 800° C. for 0.5 h so that the alloy melt obtained in Step (3) and added $Cr_2O_3$ react: $Cr_2O_3+2Al—Al_2O_3+2Cr$; the product Cr simple substance dissolves in the alloy melt, while the tiny $Al_2O_3$ particles diffuse in alloy melt;

(5) Casting and Cooling

Cast the alloy melt obtained in Step (4) into preheated mould; then cool the obtained casting along with the mould down to indoor temperature and make high-strength dissoluble aluminum alloy materials.

Example 10

The invention provides a kind of high-strength dissoluble aluminum alloy and prepares according to following method:

(1) Smelt the Aluminum Matrix at High Temperature.

Weigh aluminum ingot that is 60% of final total alloy weight, put into melting furnace, heat up to 710° C. and let it turn into melt;

(2) Weight Proportion, Smelting and Mixing of Functional Metal

Add Sn: 13.0 wt. %, Si: 2.0 wt. %, Mn: 1.5 wt. %, Mg: 4.0 wt. %, Ga: 2 wt. %, In: 5.5 wt. %, and Zn: 1.0 wt. % into the aluminum melt obtained in Step (1) according to the weight proportion, smelt into aluminum alloy for 0.5 h in 760° C.; sufficiently mix during Step (2) to turn into macroscopic uniform aluminum alloy melt;

(3) Deslagging and Degassing Process

Add polyether modified silicone defoamer that is 0.5 wt. % of total weight of the alloy melt obtained in Step (2) to carry out deslagging and degasification disposal and let alloy melt uniform;

(4) Add Metallic Oxides Into the Aluminum Alloy Melt to Form Dispersion-Reinforced Phas Cool the alloy melt down to 690° C.; weigh 11 wt. % metallic oxide $MoO_3$ and preheat 1 h under 300° C., add into alloy melt, mix sufficiently and keep in constant 800° C. for 0.5 h so that the alloy melt obtained in Step (3) and added MoO3 react: $MoO_3+2Al—Al_2O_3+Mo$; the product Mo simple substance dissolves in the alloy melt, while the tiny $Al_2O_3$ particles diffuse in alloy melt;

(5) Casting and Cooling

Cast the alloy melt obtained in Step (4) into preheated mould; then cool the obtained casting along with the mould down to indoor temperature and make high-strength dissoluble aluminum alloy materials.

Example 11

The invention provides a kind of high-strength dissoluble aluminum alloy. The raw materials of the listed high-strength dissoluble aluminum alloy include: aluminum, functional metal, metallic oxide; the added proportion of the listed aluminum and functional metal is: aluminum: 60 wt. %; functional metal: 39.9 wt. %; the added proportion of the listed metallic oxide is: 0.1 wt. %. The proportion of the functional metals is as below: Sn: 20 wt. %, Si: 0 wt. %, Mn: 0.1 wt. %, Mg: 0 wt. %, Ga: 15 wt. %, In: 4.8 wt. %, and Zn: 0 wt. %.

The listed metallic oxide is $MoO_3$.

The preparation method of the high-strength dissoluble alluminum alloy includes following steps:

(1) Smelt the Aluminum Matrix at High Temperature.

Put aluminum ingot into melting furnace, heat up to 660-800° C. and let it turn into aluminum melt;

(2) Add functional metal and smelt into aluminum alloy together with alluminum substrate. Step (2) includes weight proportion, smelting and mixing courses.

Add functional metal into the aluminum melt obtained in Step (1) according to the weight proportion, mix sufficiently and keep 2 h in 660-800° C. to turn into macroscopic uniform aluminum alloy melt.

(3) Deslagging and Degassing Process

Add defoamer obtained in Step (2) to carry out deslagging and degasification disposal and let alloy melt uniform; the defoamer mentioned in Step (3) is polyether modified silicone and the added proportion is 1.0 wt. % of the total weight of the aluminum alloy melt obtained in Step (2);

(4) Add Metallic Oxides Into the Aluminum Alloy Melt to Form Dispersion-Reinforced Phas Prehent the metallic oxide for 1 h under 200° C. and cool the alloy melt down to 680° C.; then add metallic oxide into the alloy melt that has been cooled to 680° C.; mix sufficiently and keep 2 h in 660-800° C.;

(5) Casting and Cooling

Cast the alloy melt obtained in Step (4) into preheated mould; then cool the obtained casting along with the mould down to indoor temperature and make high-strength dissoluble aluminum alloy workpiece.

Example 12

The invention provides a kind of high-strength dissoluble aluminum alloy. The raw materials of the listed high-strength dissoluble aluminum alloy include: aluminum, functional metal, metallic oxide; the added proportion of the listed aluminum and functional metal is: aluminum: 99 wt. %; functional metal: 0.9 wt. %; the added proportion of the listed metallic oxide is: 0.1 wt. %. The proportion of the functional metal is 0.1 wt. % of Sn, 0 wt. % of Si, 0.2 wt. % of Mn, 0 wt. % of Mg, 0.1 wt. % of Ga, 0.1 wt. % of In, and 0.4 wt. % of Zn.

The oxide is manganese dioxide ($MnO_2$).

The preparation method for high-strength soluble aluminum alloy comprises the following steps:

(1) Smelt the Aluminum Matrix at High Temperature

Put the aluminum ingot into a melting furnace, heating to 800-1000° C. to fuse into molten aluminum;

(2) Add functional metal, aluminum matrix fuse to form aluminum alloy; step (2) includes the steps of mass proportion, melting and stirring process.

The functional metal is added into the aluminum melt by weight percent in the step (1). The mixture shall be sufficiently stirred and kept at 800-1000° C. for 0.5 hour to make the aluminum alloy melt with macroscopic and uniform property.

(3) Deslagging and Degassing Process

Add the alloy melt obtained in the step (2) to the antifoaming agent to carry out the degassing and slag-removing treatment and homogenizing the alloy melt. The main components of antifoaming agent mentioned in step (3) is polyether modified silicon, and the adding amount is 0.2 wt. % of the total weight of alloy melted in the step (2).

(4) Add Metallic Oxides Into the Aluminum Alloy Melt to Form Dispersion-Reinforced Phas The metal oxide was preheated at 300° C. for 1 hour and the alloy melt was cooled to 700° C. Thereafter, the metal oxide was added to the alloy melt and cooled to 700° C., sufficiently stirred, and held at 800-1000° C. for 0.5 hour;

(5) Casting and Cooling

Cast the alloy melt obtained in the step (4) into a preheated mold; and then cooling the casting to the room temperature together with the mold to obtain a high-strength soluble aluminum alloy work-piece.

Example 13

The present invention provides a high-strength soluble aluminum alloy. The raw material of the high-strength soluble aluminum alloy includes: aluminum, a functional metal, and a metal oxide. The adding amount of said aluminum and functional metal is 62.99 wt. % of aluminum and 37 wt. % of functional mental. The adding amount of metal oxide is about 0.01 wt. %.

The proportion of the functional metal is 10 wt. % of Sn, 10 wt. % of Si, 5 wt. % of Mn, 10 wt. % of Mg, 1 wt. % of Ga, 1 wt. % of In, and 0 wt. % of Zn.

The oxide is chromic oxide ($Cr_2O_3$).

The preparation method for high-strength soluble aluminum alloy comprises the following steps:

(1) Smelt the Aluminum Matrix at High Temperature

Put the aluminum ingot into a melting furnace, heating to 820-880° C. to fuse into molten aluminum;

(2) Add Functional Metal, Aluminum Matrix Fuse to Form Aluminum Alloy; Step (2) Includes the Steps of Mass Proportion, Melting and Stirring Process.

The functional metal is added into the aluminum melt by weight percent in the step (1). The mixture shall be sufficiently stirred and kept at 900-950° C. for 1 hour to make the aluminum alloy melt with macroscopic and uniform property.

(3) Deslagging and Degassing Process

Add the alloy melt obtained in the step (2) to the antifoaming agent to carry out the degassing and slag-removing treatment and homogenizing the alloy melt. The main components of antifoaming agent mentioned in step (3) is polyether modified silicon, and the adding amount is 1.0 wt. % of the total weight of alloy melted in the step (2).

(4) Add Metallic Oxides Into the Aluminum Alloy Melt to Form Dispersion-Reinforced Phas The metal oxide was preheated at 250° C. for 2 hour and the alloy melt was cooled to 690° C. Thereafter, the metal oxide was added to the alloy melt and cooled to 690° C., sufficiently stirred, and held at 850-900° C. for 1 hour;

(5) Casting and Cooling

Cast the alloy melt obtained in the step (4) into a preheated mold; and then cooling the casting to the room temperature together with the mold to obtain a high-strength soluble aluminum alloy work-piece.

Example 14

The present invention provides a high-strength soluble aluminum alloy. The raw material of the high-strength soluble aluminum alloy includes: aluminum, a functional metal, and a metal oxide. The adding amount of said aluminum and functional metal is 61.79 wt. % of aluminum and 38.2 wt. % of functional mental. The adding amount of metal oxide is about 0.01 wt. %.

The proportion of the functional metal is 0.1 wt. % of Sn, 5 wt. % of Si, 10 wt. % of Mn, 5 wt. % of Mg, 0.1 wt. % of Ga, 10 wt. % of In, and 8 wt. % of Zn.

The metal oxides are nickel oxide (NiO) and vanadium pentoxide ($V_2O_5$). The weight ratio of nickel oxide (NiO) and vanadium pentoxide ($V_2O_5$) is 1:1.

The preparation method for high-strength soluble aluminum alloy comprises the following steps:

(1) Smelt the Aluminum Matrix at High Temperature

Put the aluminum ingot into a melting furnace, heating to 660-700° C. to fuse into molten aluminum;

(2) Add Functional Metal, Aluminum Matrix Fuse to Form Aluminum Alloy; Step (2) Includes the Steps of Mass Proportion, Melting and Stirring Process.

The functional metal is added into the aluminum melt by weight percent in the step (1). The mixture shall be sufficiently stirred and kept at 660-700° C. for 2 hour to make the aluminum alloy melt with macroscopic and uniform property.

(3) Deslagging and Degassing Process

Add the alloy melt obtained in the step (2) to the antifoaming agent to carry out the degassing and slag-removing treatment and homogenizing the alloy melt. The main components of antifoaming agent mentioned in step (3) is polyether modified silicon, and the adding amount is 0.5 wt. % of the total weight of alloy melted in the step (2).

(4) Add Metallic Oxides Into the Aluminum Alloy Melt to Form Dispersion-Reinforced Phas The metal oxide was preheated at 300° C. for 1 hour and the alloy melt was cooled to 680° C. Thereafter, the metal oxide was added to the alloy melt and cooled to 680° C., sufficiently stirred, and held at 900-950° C. for 2 hour;

(5) Casting and Cooling

Cast the alloy melt obtained in the step (4) into a preheated mold; and then cooling the casting to the room temperature together with the mold to obtain a high-strength soluble aluminum alloy work-piece.

Example 15

The present invention provides a high-strength soluble aluminum alloy. The raw material of the high-strength soluble aluminum alloy includes: aluminum, a functional metal, and a metal oxide. The adding amount of said aluminum and functional metal is 68 wt. % of aluminum and 29 wt. % of functional mental. The adding amount of metal oxide is about 3 wt. %.

The proportion of the functional metal is 1 wt. % of Sn, 4 wt. % of Si, 3 wt. % of Mn, 5 wt. % of Mg, 7 wt. % of Ga, 5 wt. % of In, and 4 wt. % of Zn.

The oxide is silicon dioxide ($SiO_2$).

The preparation method for high-strength soluble aluminum alloy comprises the following steps:

(1) Smelt the Aluminum Matrix at High Temperature

Put the aluminum ingot into a melting furnace, heating to 900-1000° C. to fuse into molten aluminum;

(2) Add Functional Metal, Aluminum Matrix Fuse to Form Aluminum Alloy; Step (2) Includes the Steps of Mass Proportion, Melting and Stirring Process.

The functional metal is added into the aluminum melt by weight percent in the step (1). The mixture shall be sufficiently stirred and kept at 950-1000° C. for 1 hour to make the aluminum alloy melt with macroscopic and uniform property.

(3) Deslagging and Degassing Process

Add the alloy melt obtained in the step (2) to the antifoaming agent to carry out the degassing and slag-removing treatment and homogenizing the alloy melt. The main components of antifoaming agent mentioned in step (3) is polyether modified silicon, and the adding amount is 1.0 wt. % of the total weight of alloy melted in the step (2).

(4) Add Metallic Oxides Into the Aluminum Alloy Melt to Form Dispersion-Reinforced Phas The metal oxide was preheated at 300° C. for 1 hour and the alloy melt was cooled to 680° C. Thereafter, the metal oxide was added to the alloy melt and cooled to 680° C., sufficiently stirred, and held at 950-1000° C. for 0.5 hour;

(5) Casting and Cooling

Cast the alloy melt obtained in the step (4) into a preheated mold; and then cooling the casting to the room temperature together with the mold to obtain a high-strength soluble aluminum alloy work-piece.

Example 16

The present invention provides a high-strength soluble aluminum alloy. The raw material of the high-strength soluble aluminum alloy includes: aluminum, a functional metal, and a metal oxide. The adding amount of said aluminum and functional metal is 98 wt. % for aluminum. The adding amount of functional mental and metal oxide is about 2 wt. %.

Includes 0.1 wt. % of Sn, 0 wt. % of Si, 0.1 wt. % of Mn, 0 wt. % of Mg, 0.1 wt. % of Ga, 0.1 wt. % of In, and 0 wt. % of Zn.

The metal oxides are nickel oxide (NiO) and manganese dioxide ($MnO_2$), with the weight percentage of 1.6%. The weight ratio of nickel oxide (NiO) and manganese dioxide ($MnO_2$) is 1:1.

According to the preparation method of example 1, we can have high-strength soluble aluminum alloy.

Example 17

The present invention provides a high-strength soluble aluminum alloy. The raw material of the high-strength soluble aluminum alloy includes: aluminum, a functional metal, and a metal oxide. The adding amount of said aluminum and functional metal is 99 wt. % for aluminum. The adding amount of functional mental and metal oxide is about 1 wt. %.

Includes 0.2 wt. % of Sn, 0.1 wt. % of Si, 0.2 wt. % of Mn, 0 wt. % of Mg, 0.1 wt. % of Ga, 0.1 wt. % of In, and 0.1 wt. % of Zn.

The metal oxides are nickel oxide (NiO), with the weight percentage of 0.2%.

According to the preparation method of example 1, we can have high-strength soluble aluminum alloy.

TABLE 1

Test results for high-strength soluble aluminum alloy provided in Examples 1 to 17.

| | Compressive strength (MPa) | Bending strength (MPa) | Dissolution rate (mm/h) |
|---|---|---|---|
| Example 1 | 366 | 831 | 1.78 |
| Example 2 | 394 | 815 | 0.58 |
| Example 3 | 351 | 799 | 0.83 |
| Example 4 | 316 | 817 | 1.51 |
| Example 5 | 276 | 721 | 2.39 |
| Example 6 | 246 | 689 | 2.52 |
| Example 7 | 234 | 673 | 2.6 |
| Example 8 | 123 | 311 | 3.03 |
| Example 9 | 156 | 338 | 2.82 |
| Example 10 | 210 | 400 | 3.84 |
| Example 11 | 201 | 513 | 4.01 |
| Example 12 | 73 | 337 | 1.2 |
| Example 13 | 133 | 314 | 2.27 |
| Example 14 | 165 | 326 | 1.44 |
| Example 15 | 187 | 396 | 1.06 |
| Example 16 | 263 | 591 | 1.28 |
| Example 17 | 211 | 462 | 1.36 |

As can be seen from the test results in Table 1, the present invention provides a high-strength soluble aluminum alloy having high compressive and flexural strength and a faster dissolution rate. In particular, the high-strength soluble aluminum alloys provided in Examples 1 to 4 have higher compressive strength and flexural strength as well as a suitable dissolution rate.

The above description is only for the preferred embodiment of the present invention and is not intended to limit the scope of the present invention. Variations and modifications in accordance with the present invention are intended to be within the scope of the present invention.

The invention claimed is:

1. A method for preparing a high-strength soluble aluminum alloy, wherein raw materials of the method comprise aluminum, functional metals and metallic oxide, the functional metals are Ga, Mn, In, Sn, Mg, Zn and Si, wherein addition amounts of the aluminum and the functional metals are 87 wt. % of Al, 8.0 wt. % of Sn, 0.1 wt. % of Si, 0.2 wt. % of Mn, 1.0 wt. % of Mg, 0.1 wt. % of Ga, 0.3 wt. % of In, and 0.3 wt. % of Zn, and the metallic oxide is 3 wt. % of $TiO_2$, or a mixture of 2 wt. % of $TiO_2$, 0.5 wt. % of $Cr_2O_3$ and 0.5 wt. % of $MoO_3$, wherein the method comprises following steps:

(1) firstly melting aluminum to produce an aluminum melt, wherein the melting temperature is 660-1,000° C.;

(2) adding functional metals to the aluminum melt according to the addition amounts of the functional metals;

(3) deslagging and degassing the aluminum melt, and then adding metallic oxide preheated to a temperature of 200-300° C.; and (4) mixing the aluminum, the functional metals and the metallic oxide to make alloy ingredients uniform; and manufacturing, after a process of alloying is completed, workpiece products by a casting process.

2. The method for preparing the high-strength soluble aluminum alloy according to claim 1, wherein the melting temperature in step (1) is 710° C.

3. The method for preparing the high-strength soluble aluminum alloy according to claim 1, wherein step (2) comprises adding functional metals to the aluminum melt according to the addition amounts of the functional metals, fully stirring and preserving heat at 760° C.

4. The method for preparing the high-strength soluble aluminum alloy according to claim 1, wherein step (2) comprises adding functional metals to the aluminum melt according to the addition amounts of the functional metals, fully stirring and preserving heat at 760° C. for 30 minutes.

5. The method for preparing the high-strength soluble aluminum alloy according to claim 1, wherein step (3) comprises adding metallic oxide preheated to a temperature of 300° C.

6. The method for preparing the high-strength soluble aluminum alloy according to claim 1, wherein step (3) comprises adding metallic oxide preheated to a temperature of 300° C. for 1 hour.

* * * * *